United States Patent [19]

Perry

[11] Patent Number: 4,651,427

[45] Date of Patent: Mar. 24, 1987

[54] MEASURING DEVICE FOR CLOTHING PATTERNS

[75] Inventor: Patricia Perry, Mount Vernon, N.Y.

[73] Assignee: Butterick Company, Inc., New York, N.Y.

[21] Appl. No.: 851,946

[22] Filed: Apr. 14, 1986

[51] Int. Cl.[4] ..... A41H 1/00

[52] U.S. Cl. ..... 33/2 R; 33/7; 33/15; 33/392

[58] Field of Search ..... 33/2 R, 7, 11, 12, 392, 33/15, 16, 391, 373

[56] References Cited

U.S. PATENT DOCUMENTS

| | | | |
|---|---|---|---|
| 942,338 | 12/1909 | Morrison | 33/2 R |
| 1,248,035 | 11/1917 | Taylor | 33/2 R |
| 1,265,122 | 5/1918 | Scott | 33/2 R |
| 1,431,298 | 10/1922 | Galassi | 33/2 R |
| 3,964,169 | 6/1976 | Bush | 33/15 |

*Primary Examiner*—Willis Little

*Attorney, Agent, or Firm*—Stuart S. Bowie

[57] ABSTRACT

A device for measuring crotch-to-waist length especially useful for clothing patterns.

1 Claim, 2 Drawing Figures

MEASURING DEVICE FOR CLOTHING PATTERNS

BACKGROUND OF THE INVENTION

The present invention relates to a Measuring Device that is useful in making articles of clothing from paper patterns.

Several companies, including the Assignee hereof, manufacture and sell paper patterns for clothing, particularly for women's clothing, to be used to fashion garments at home.

The patterns are, of course, sold by size and contain markings indicating how the cloth should be cut along the pattern template. However, as is known, each person has a body configuration which is unique. Accordingly, in order to obtain an optimum fit, the pattern marking must be altered by actual measurement to fit the particular individual for whom the garment is to be fashioned.

For this connection, a particularly important dimension is the crotch-to-waistline measurement, especially for pants, shorts, leotards and the like wherein the garment has a crotch section. To date, no adequate—or accurate—means has been devised to take these measurements.

SUMMARY OF THE INVENTION

The present invention comprises a device for accurately measuring the crotch to waistline dimension, from both the front and the back of the body. It is particularly useful for adjusting pre-marked paper patterns to show the accurate measurement of dimensions to ensure an optimum fit in the finished garment.

THE DRAWINGS

DETAILED DESCRIPTION OF THE PREFERRED EMBODIMENT

Figure 1:
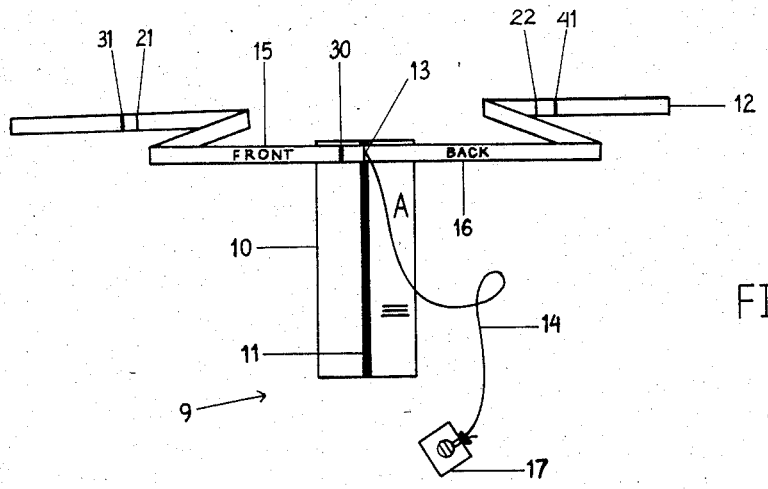
FIG. 1 is a perspective view of one embodiment of the crotch length measuring device of this invention.

As shown in FIG. 1, the measuring device 9 comprises a crotch centering means, which, as shown, is a card 10, which may be cardboard, with a center-line 11 extending vertically down its central longitudinal axis.

At the top of card 10 there is attached a flexible tape 12. For convenience, as shown, the tape may contain the legends "Front" and "Back" to simply indicate to the person making the measurements which portion of the tape is used to measure the front crotch to waist measurements and the back (ie, rear of the body) crotch to waist measurement.

The tape 12 has a line 13 which is in direct vertical alignment with center-line 11 of card 10. At position 13, there is attached a flexible member 14, eg a string, at the bottom of which is attached a weight (plumb) 17.

Figure 2:
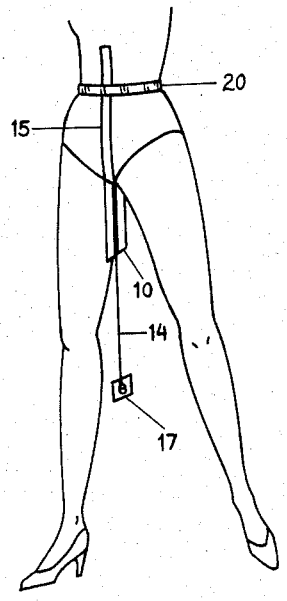
FIG. 2 is a perspective view of the device of FIG. 1 as worn by a female in the process of utilizing the same to measure her front and back crotch-length.

FIG. 2 shows how the device 9 is attached to the body of the person (here shown as a female but it could also be a male) for the crotch-to-waist measurements.

As shown in FIG. 2, the person positions the Card 10 between her legs so that the Card 10 (preferably) lies against her right leg. When correctly positioned, the plumb line 14 extends along the center line 11 of card 10, thus ensuring that the device 9 is positioned at the center of the crotch.

When this "plumb" position is obtained, as shown in FIG. 2, the "Front" position 15 of the tape 12 is snugly drawn up under a band 20 fastened around the person's waistline and, although not shown, the "Back" position 16 of tape 12 is drawn under band 20 along the spine of the rear of the person's body.

When the above occurs, the person (or an assistant) marks the junction 21 of the Front tape portion 15 with band 20 and the junction 22 of Back portion 16 with band 20—thereby accurately measuring front and back crotch-to-waist dimensions.

As a practical matter, to provide some ease in the garment, the person making the garment makes a mark 30 on tape portion 15 eg, 20 mm from line 13, and a similar mark 31, of 10–20 mm from line 21, to provide some extra room in the garment. For ease of wearing comfort, a similar adjusting mark 41 may be made on tape section 16 (eg, 10–20 mm from line 22).

Tape 12, which may or may not contain measuring indicia (eg, inches, milimeters), so marked is then used to alter the paper pattern to ensure optimum back and front crotch-to-waist fit.

I claim:

1. A device for measuring crotch to waist dimensions of a person comprising:

(a) a crotch centering means including a center line extending vertically down the central vertical axis thereof;

(b) a plumb line, including a weight, attached to said centering means at a point in alignment with said center line;

(c) a flexible measuring means attached to said centering means and having front and back sections, each of which is of a length to extend from opposite sides of said centering means to the waistline of the wearer.

* * * * *